US008539799B2

(12) United States Patent
Nave et al.

(10) Patent No.: US 8,539,799 B2
(45) Date of Patent: Sep. 24, 2013

(54) COMBINATION LOCK

(75) Inventors: Zachery Nave, Oak Creek, WI (US); Xian Bo Chen, ChongYi (CN)

(73) Assignee: Master Lock Company LLC, Oak Creek, WI (US)

( * ) Notice: Subject to any disclaimer, the term of this patent is extended or adjusted under 35 U.S.C. 154(b) by 926 days.

(21) Appl. No.: 11/952,578

(22) Filed: Dec. 7, 2007

(65) Prior Publication Data

US 2009/0145178 A1 Jun. 11, 2009

(51) Int. Cl.
*E05B 37/10* (2006.01)

(52) U.S. Cl.
USPC ..... 70/21; 70/24; 70/25

(58) Field of Classification Search
USPC ..... 70/21–22, 24–25, 332, 284, 285
See application file for complete search history.

(56) References Cited

U.S. PATENT DOCUMENTS

| | | | | |
|---|---|---|---|---|
| 427,421 | A | 5/1890 | Jackson | |
| 747,116 | A | 12/1903 | Amstalden | |
| 1,583,402 | A | 5/1926 | Lewis | |
| 1,674,901 | A | 6/1928 | Ibarrart | |
| 2,078,168 | A | 4/1937 | Stone et al. | |
| 3,611,761 | A | 10/1971 | Atkinson | |
| 3,766,758 | A | 10/1973 | Heine et al. | |
| 3,983,724 | A | 10/1976 | Foote | |
| 4,100,775 | A | 7/1978 | Bako | |
| 4,557,122 | A | 12/1985 | Hwang | |
| 4,895,036 | A | 1/1990 | Larson et al. | |
| 5,237,842 | A | 8/1993 | Rasch et al. | |
| 6,708,534 | B1 * | 3/2004 | Ruan | 70/38 A |
| 6,845,643 | B2 | 1/2005 | Tsai | |
| 6,877,345 | B1 | 4/2005 | Misner et al. | |
| 6,883,355 | B2 * | 4/2005 | Lai | 70/25 |
| 6,955,069 | B2 | 10/2005 | Segawa et al. | |
| 7,467,531 | B2 * | 12/2008 | Lai et al. | 70/38 C |
| 2003/0136160 | A1 | 7/2003 | Segawa | |
| 2004/0134242 | A1 | 7/2004 | Wyers | |
| 2006/0169007 | A1 * | 8/2006 | Fiegener | 70/25 |

FOREIGN PATENT DOCUMENTS

CN 2828251 10/2006

OTHER PUBLICATIONS

International Search Report and Written Opinion from International Application No. PCT/US08/67439 mailed Sep. 29, 2008.
Office Action from Chinese Patent Application No. 200710300489.4 date of issue Jun. 3, 2011.

* cited by examiner

*Primary Examiner* — Kristina Fulton
(74) *Attorney, Agent, or Firm* — Calfee, Halter & Griswold LLP

(57) ABSTRACT

A combination lock includes a locking mechanism, a code identifying member, and a plurality of user rotatable dials, with a recess disposed on an outer periphery of each dial. The locking mechanism includes a plurality of dial engaging members configured to hold the locking mechanism in a locking position. When each of the dials is rotated to an unlocking orientation, the recesses align with the dial engaging members, allowing the locking mechanism to move from the locking position to an unlocking position. When the code identifying member is moved to a code identifying condition, the dial engaging members are in biased engagement with the dials, such that rotation of any one of the dials to the unlocking orientation causes the corresponding dial engaging member to engage the corresponding recess to provide a perceptible indication that the dial is in the unlocking orientation.

17 Claims, 8 Drawing Sheets

COMBINATION LOCK

BACKGROUND

Combination locks are used in commercial, residential, and institutional environments to provide lockable access to personal items and/or enclosures. The combination lock may be a separate device, such as a combination padlock, which may be shackled to a door, bracket, cable, or other item to restrict access. Alternatively, the combination lock may be integral to an enclosure, such as a safe or a storage locker. Combination locks include single-dial and multiple-dial designs.

While the use of a combination lock, as compared to a key based lock, may eliminate the risk of lost, stolen, or copied keys, an authorized combination may be forgotten, preventing access to the locked item by the authorized user. Further, in a situation where an administrator or other such individual needs access to the locked item or items, it may be difficult or impossible to keep track of the authorized combinations, particularly where the combination code is changeable by the user.

SUMMARY OF THE DISCLOSURE

In accordance with an inventive aspect of the present application, a multiple-dial combination lock may be provided with a mechanism or arrangement for identifying the authorized combination code corresponding to an unlocking orientation of the dials. The code identifying mechanism may be movable between a code concealing condition and a code identifying condition, for example, through use of a key-operated mechanism and a proper key, to prevent unauthorized users from learning the combination code. When the code identifying mechanism is in the code identifying condition, rotation of each dial to its unlocking orientation provides a perceptible indication that the unlocking orientation has been reached.

Accordingly, in one exemplary embodiment, a combination lock includes a locking mechanism, a code identifying member, and a plurality of user rotatable dials, with a recess disposed on an outer periphery of each dial. The locking mechanism includes a plurality of dial engaging members configured to hold the locking mechanism in a locking position. Under normal operating conditions, when the code is known by the user, each of the dials is rotated to a known unlocking orientation by the user. The recesses then align with the dial engaging members, allowing the locking mechanism to move from the locking position to an unlocking position. When the code identifying member is moved to a code identifying condition by an authorized user who does not know or has forgotten the code, the dial engaging members are in biased engagement with the dials, such that random rotation of any one of the dials to the unknown or forgotten unlocking orientation causes the corresponding dial engaging member to engage the corresponding recess to provide a perceptible indication that the dial is in the unlocking orientation.

BRIEF DESCRIPTION OF THE DRAWINGS

Further features and advantages of the invention will become apparent from the following detailed description made with reference to the accompanying drawings, wherein.

DETAILED DESCRIPTION OF THE INVENTION

The present application relates to combination lock arrangements that may be used with many different types of locks, such as, for example, combination padlocks, safe locks, and integral locks for lockers, mailboxes, storage sheds, or other such structures and enclosures. While the embodiments described in the present application refer to a multiple-dial combination padlock, the inventive aspects described herein may be applied to any type of lock incorporating any number of combination dials. This Detailed Description merely describes exemplary embodiments and is not intended to limit the scope of the claims in any way. Indeed, the invention as recited in the claims is broader than and unlimited by the described embodiments, and the terms used have their full ordinary meaning.

According to one aspect of the present application, a multiple-dial combination lock utilizing a mechanical locking mechanism, such as, for example, a shackle lockably engaged by one or more locking members (for example, ball bearings), may be provided with a code identifying arrangement that allows an authorized user or administrator to ascertain the combination code for the lock. When the code identifying arrangement is operated or moved to a code identifying condition, rotation of each dial to its unlocking orientation provides a perceptible indication that the unlocking orientation has been reached. The code identifying arrangement may be configured to provide many different types of perceptible indications of the unlocking orientation, including, for example, audible indicators (such as a click or beep), visual indicators (such as a light), or tactile indicators (such as a resistance to rotation or impeded rotation in one or both directions). One exemplary embodiment of such a combination lock is described in co-pending U.S. patent application Ser. No. 11/766,462, entitled "Combination Lock" and filed on Jun. 21, 2007, the entire contents of which are incorporated herein by reference, to the extent they are not conflicting with the present application.

Figure 1:
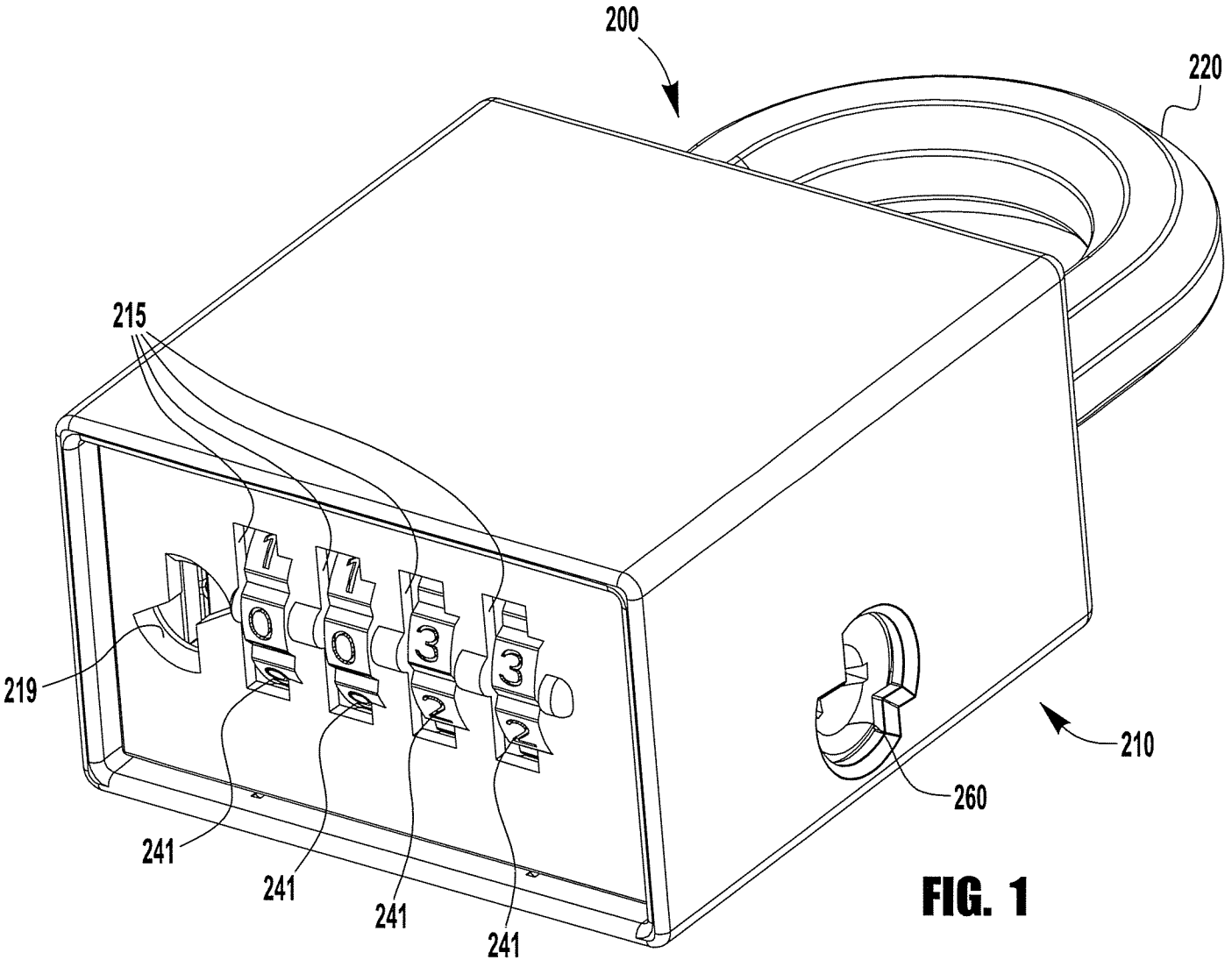
FIG. 1 is a perspective view of a combination lock.

Referring now to the drawings, FIGS. 1-7 illustrate an exemplary embodiment of a multiple-dial combination padlock 200 having a key operated code identifying arrangement. As shown in FIG. 1, the exemplary padlock 200 includes a lock body 210 configured to retain a shackle 220, and a series of dials 241, partially exposed through openings 215 in the lock body 210 to allow user rotation of the dials 241. The exemplary lock body 210, as shown in the exploded view of FIG. 2, includes housing portions 211*a* and 211*b*, top plate 212, outer casing 213, and wedge plate 214, which define cavities within the lock body for accommodating the internal components of the lock 200.

Figure 3:
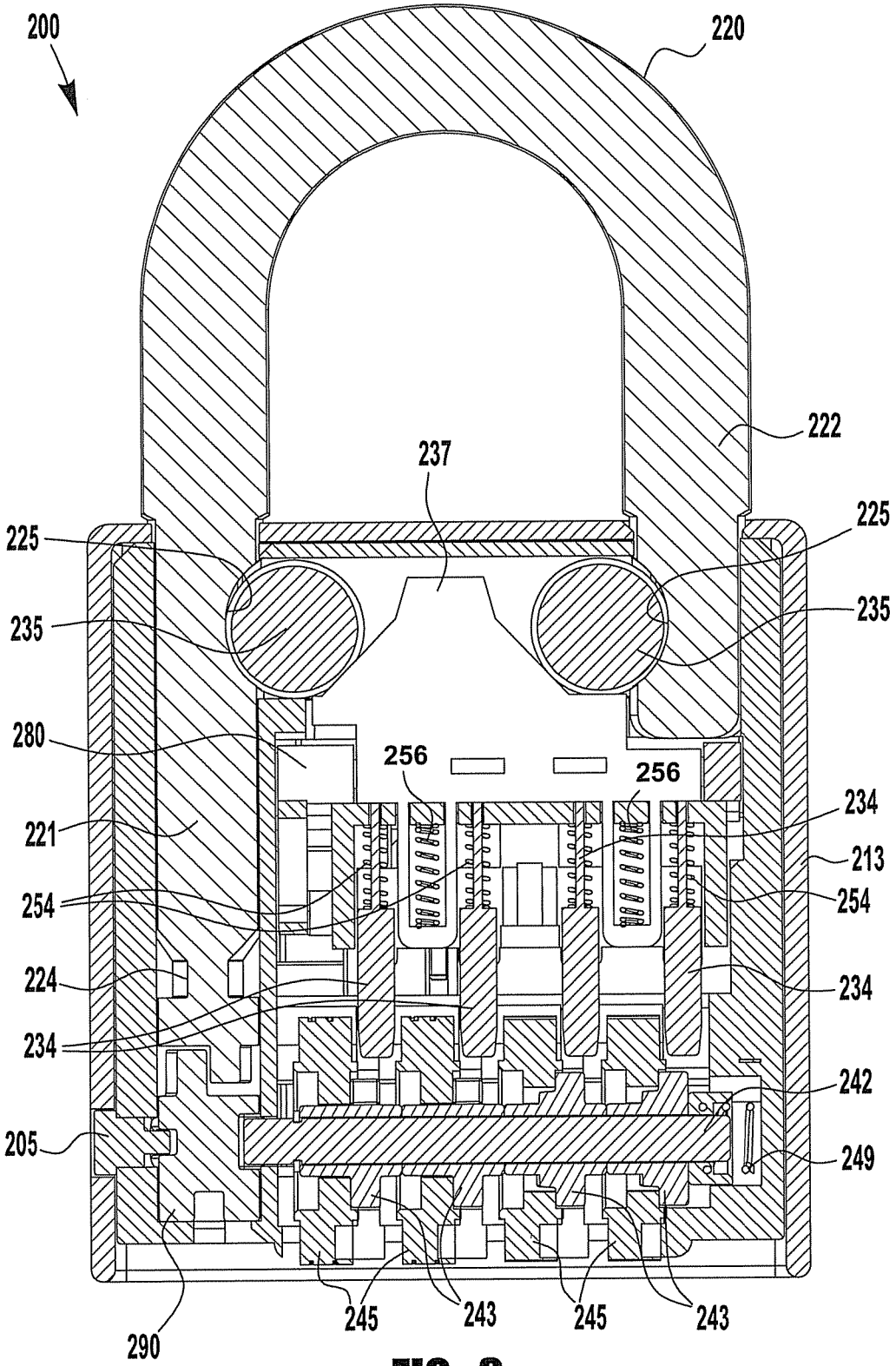
FIG. 3 is a front cross sectional view of the combination lock of FIG. 1.

The exemplary lock 200 includes a locking mechanism, discussed in greater detail below, that releases the shackle 220 from a locked condition when each of the dials 241 is rotated to an unlocking orientation. While the illustrated dials 241 include number markings to identify the rotational orientation of each wheel, any types of markings may be used (including, for example, letters, pictures, and colors). While many different locking mechanisms may be employed, in the illustrated embodiment, the shackle 220 is secured in a locked condition within the lock body 210 by a blocking member 230, which forces locking members 235 into engagement with corresponding notches 225 (as shown in FIG. 3) in the shackle 220 when the blocking member 230 is in an extended or locked condition, thereby preventing axial movement of the shackle 220.

Figure 6:
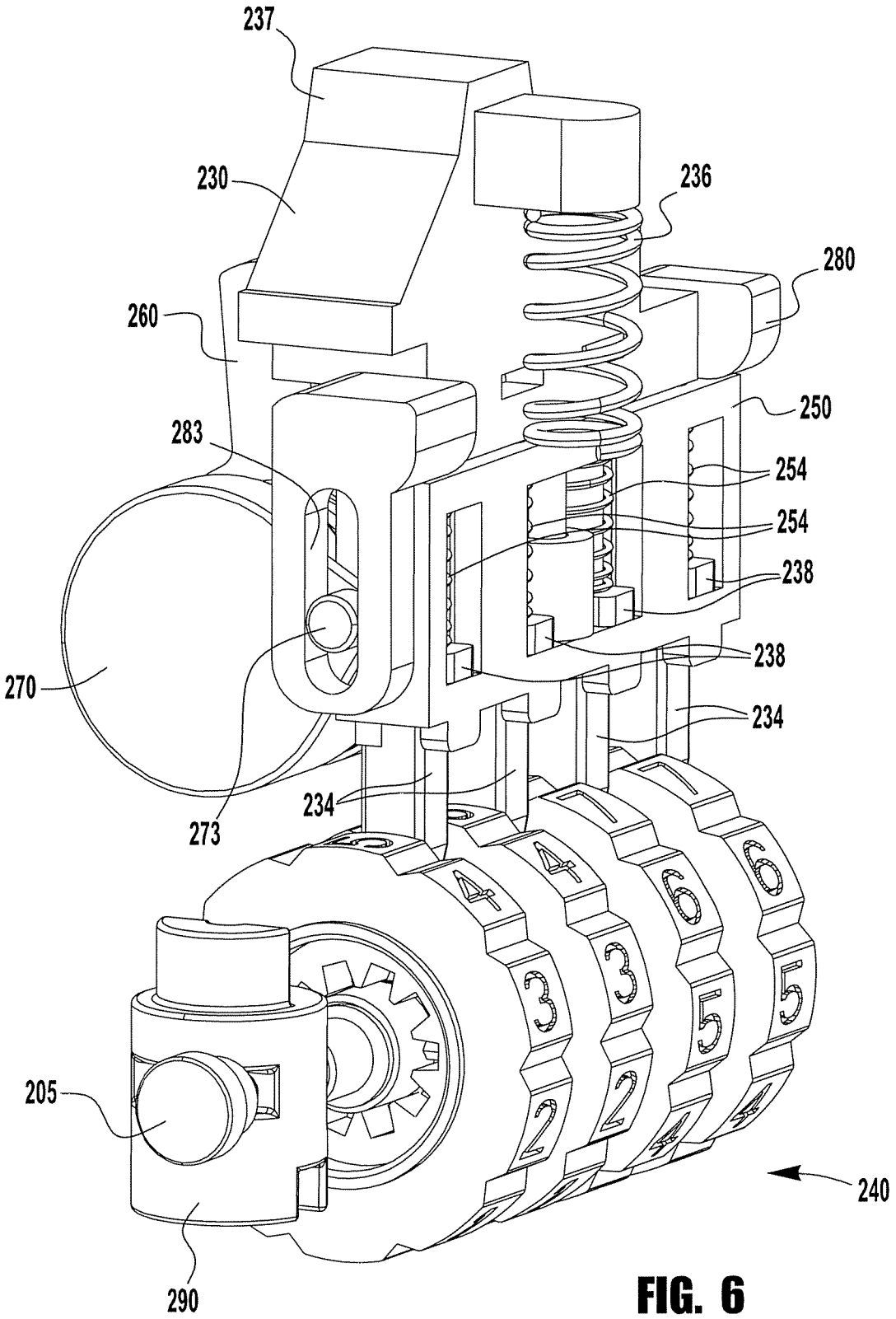
FIG. 6 is a side perspective view of the internal lock components of the combination lock of FIG. 1.

A dial assembly 240 is disposed within the lock body 210 of the exemplary lock 200, and includes a series of wheels 245 and hubs 243 rotatable about a post 242. Each of the wheels 245 engages a corresponding hub 243 on its inner diameter (for example, using interlocking gear teeth, as shown in FIG. 6), such that each of the wheels 245 engages with one of the hubs 243 to rotate together as a dial 241. The lock 200 may further include a spring detent plate 247 (see FIG. 2) to hold each of the wheels 245 in place in one of several set positions (for example, the numbered "0" through "9" positions on a conventional lock dial) when the wheels 245 are not being manually rotated by a user.

Figure 2:
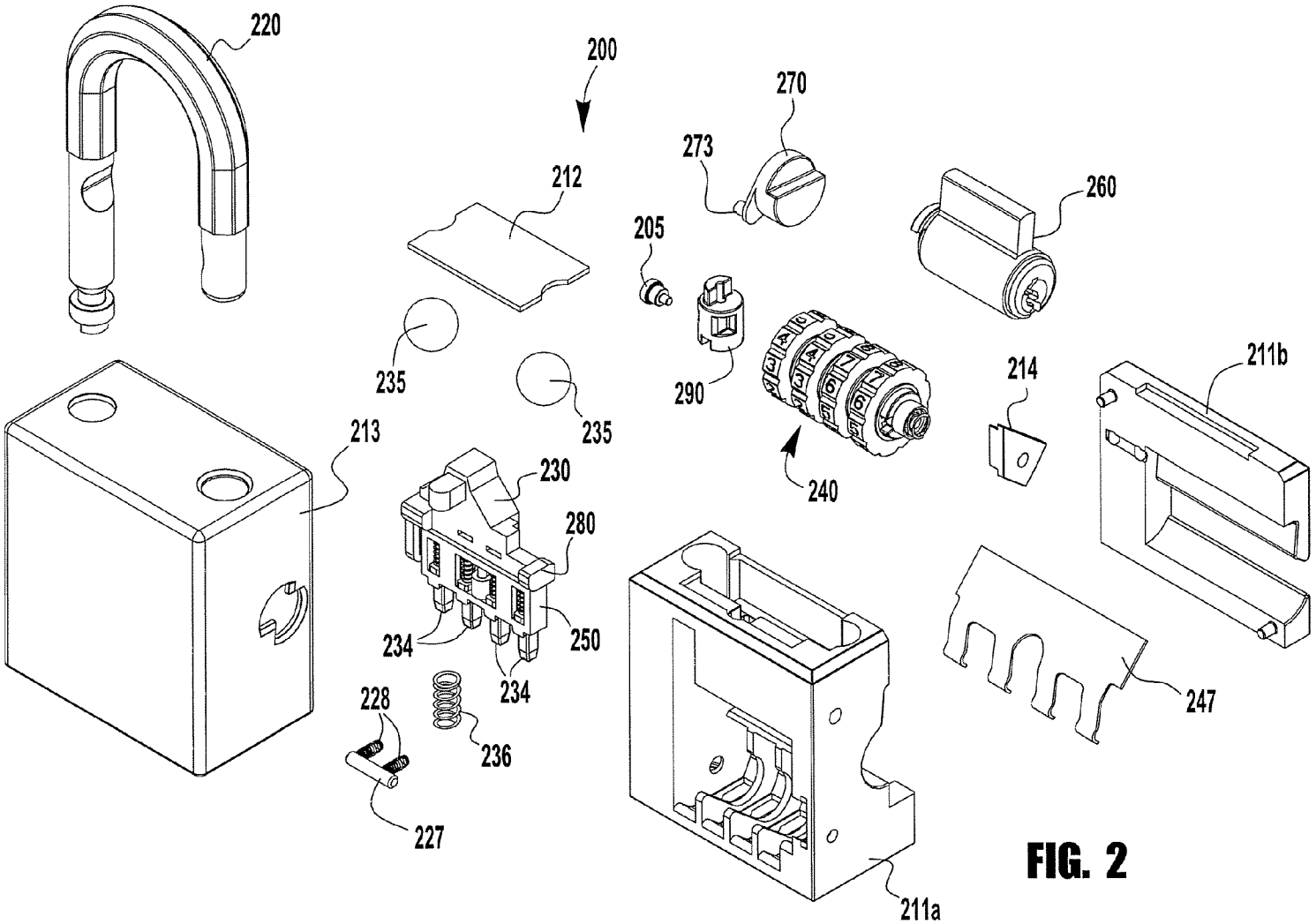
FIG. 2 is an exploded perspective view of the combination lock of FIG. 1.
Figure 4:
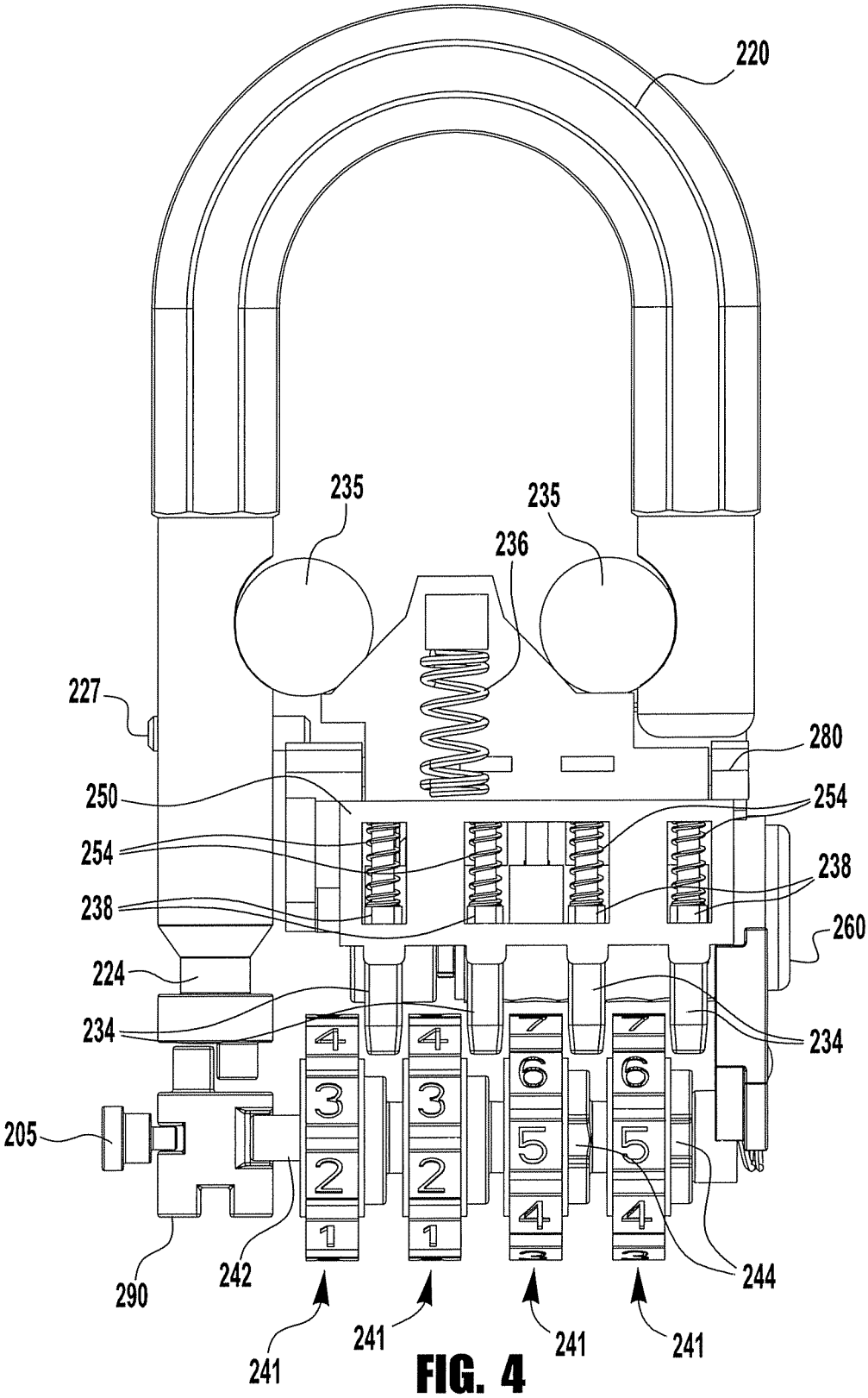
FIG. 4 is a perspective view of the internal lock components of the combination lock of FIG. 1.

Each of the hubs 243 includes an unlocking feature, such as, for example, a recess 244 (shown in FIGS. 4 and 7), disposed on an outer periphery of the hub 243. Other types of unlocking features may be utilized, including, for example, notches, ramps, or projections. The blocking member 230 may include (or may be part of a blocker assembly including) dial engaging members 234 configured to engage the recesses 244 to unlock the lock. When the recesses 244 are aligned with the dial engaging members 234, the exemplary blocking member 230 becomes axially movable from the extended or locked condition to the retracted or unlocked condition, in which the dial engaging members 234 are received in engagement with the recesses 244. In the unlocked condition, a narrow end portion 237 of the blocking member 230 axially aligns with the locking members 235, allowing the locking members 235 to disengage from the shackle notches 225, thereby allowing the shackle 220 to be axially pulled from the lock body 210 to disengage the short leg 222 of the shackle 220 from the lock body 210. As shown in FIGS. 2 and 4, a biasing spring 236 may be disposed between the blocking member 230 and the housing portion 211*a* to bias the blocking member 230 toward the locked position, such that the shackle 220 must be manually pulled by the user to force the locking members 235 inward and the blocking member 230 downward against the force of the spring 236. While many different configurations may be used to retain the long leg 221 of the shackle 220 in the lock body 210 in this unlocked condition, in the illustrated embodiment, a shackle pin 227 biased by springs 228 engages a groove 224 near the end of the long leg 221 to prevent the long leg 221 from disengaging from the lock body 210. The upper edge of the groove 224 is tapered to allow the pin 227 to be forced (against springs 228) out of the groove 224 when the shackle is returned to the locked condition. A chamfer may also be provided on a bottom surface of the shackle 220 to permit installation of the shackle after the shackle pin 227 has been installed. This may allow for installation of the shackle 220 at the end of the assembly process, which may make it easier and more efficient to provide locks having different size, shape, or material shackles.

To identify or ascertain the proper combination code of a multiple dial combination lock, a code identifying or dial engaging mechanism may be included in the lock and movable between a code concealing (or dial disengaged) condition and a code identifying (or dial engaging) condition. In the code identifying condition, the code identifying mechanism provides for independent engagement of each of the dials, such that a perceptible indication is provided when each of the dials is rotated to an unlocking orientation. To provide for independent engagement with each of the dials, the code identifying mechanism may be provided with a series of resilient pins, tabs, or other such components configured to move independent of each other and separate from the blocker assembly. In one such embodiment, portions of the blocker assembly (such as, for example, the dial engaging members) may be configured, when in the code identifying condition, to independently move and engage each of the dials to produce a perceptible indication when each dial is rotated to the unlocking orientation.

In the illustrated embodiment, the code identifying mechanism includes a slider or code identifying member 250 having a series of axially extending passages 251 (see FIG. 5B) sized to receive the dial engaging members 234 therethrough. A series of cavities 253 are aligned with the passages 251 to retain spring members 254 associated with each of the dial engaging members 234. Each of the dial engaging members 234 includes a flange portion 238 (or other suitable structure) having an upper surface that engages an end of the spring member 254, and a lower surface that abuts the bottom of the cavity 253. When the code identifying member 250 is moved to a code identifying condition (in this embodiment, axially moved downward), each the dial engaging members 234 is moved into engagement with an outer periphery of the corresponding hub 243, and the spring members 254 are compressed to provide spring loaded engagement between the code identifying member 250 and the dial engaging members 234. When one of the dials 241 is then rotated to the unlocking orientation, the corresponding spring loaded dial engaging member 234 is forced into engagement with the recess 244 to provide an indication that the unlocking orientation has been reached. While different types of engagement may be used to provide different perceptible indications (such as, for example, a click-type detent or electrical connectivity between the hub and the dial engaging mechanism), in one embodiment, the recess (or other such unlocking feature) 244 and the dial engaging member 234 may be configured to provide stopping engagement or impeded movement of the dial in one or both rotational directions. In the illustrated embodiment, upon engagement of the dial engaging member 234 with the recess 244, rotation of the dial 241 is impeded. Therefore, to identify the proper combination code, after the code identifying member 250 is moved to the code identifying condition, each dial 241 is rotated until rotation is impeded.

While a dial engaging member (such as a axially movable pin) may be provided in many different orientations and positions within the lock, in the illustrated embodiment, the dial engaging members 234 are positioned between the blocking member 230 and the dial assembly 240, such that when the dial engaging members 234 are aligned with the recesses 244, the blocking member 230, code identifying member 250, and dial engaging members 234 may all be axially moved to the unlocking position, regardless of whether the code identifying member 250 is in the code identifying condition or the code concealing condition. In other embodiments (not shown), dial contacting portions of the dial engaging members may be provided in some other orientation for engagement with the dials, and may function separately from the locking mechanism. In still other embodiments (not shown), a set of dials may be provided with a first set of unlocking features for engaging the locking mechanism (such as a blocker assembly) and a second set of features (e.g., recesses, projections, etc.) for engaging the dial engaging members, where alignment of the first set of unlocking features with the locking mechanism corresponds with alignment of the second set of features with the dial engaging members, for identification of the combination code when the dial engaging member is in the code identifying condition.

Many different mechanisms or configurations may be utilized to allow an authorized user or administrator to move a code identifying mechanism from a code concealing condition to a code identifying condition for identification of the combination code, including, for example, key-operated mechanisms, master code combinations (with wheels configured to move a dial engaging mechanism to a code identifying condition when in a predetermined "master" combination), or electronically operated mechanisms (such as an electronic key card or an infrared or radio frequency transmitter and receiver). In the illustrated embodiment, a key-operated pin tumbler cylinder 260, as known in the art, extends from a side of the lock body 210, and is operable (with a proper key) to move the code identifying member 250 into the dial engaging position. The lock 200 may be configured to use a conventional key cylinder, consistent with a door key cylinder, such that an authorized user may use his or her house key to identify the combination code on the combination lock.

Figure 5A:
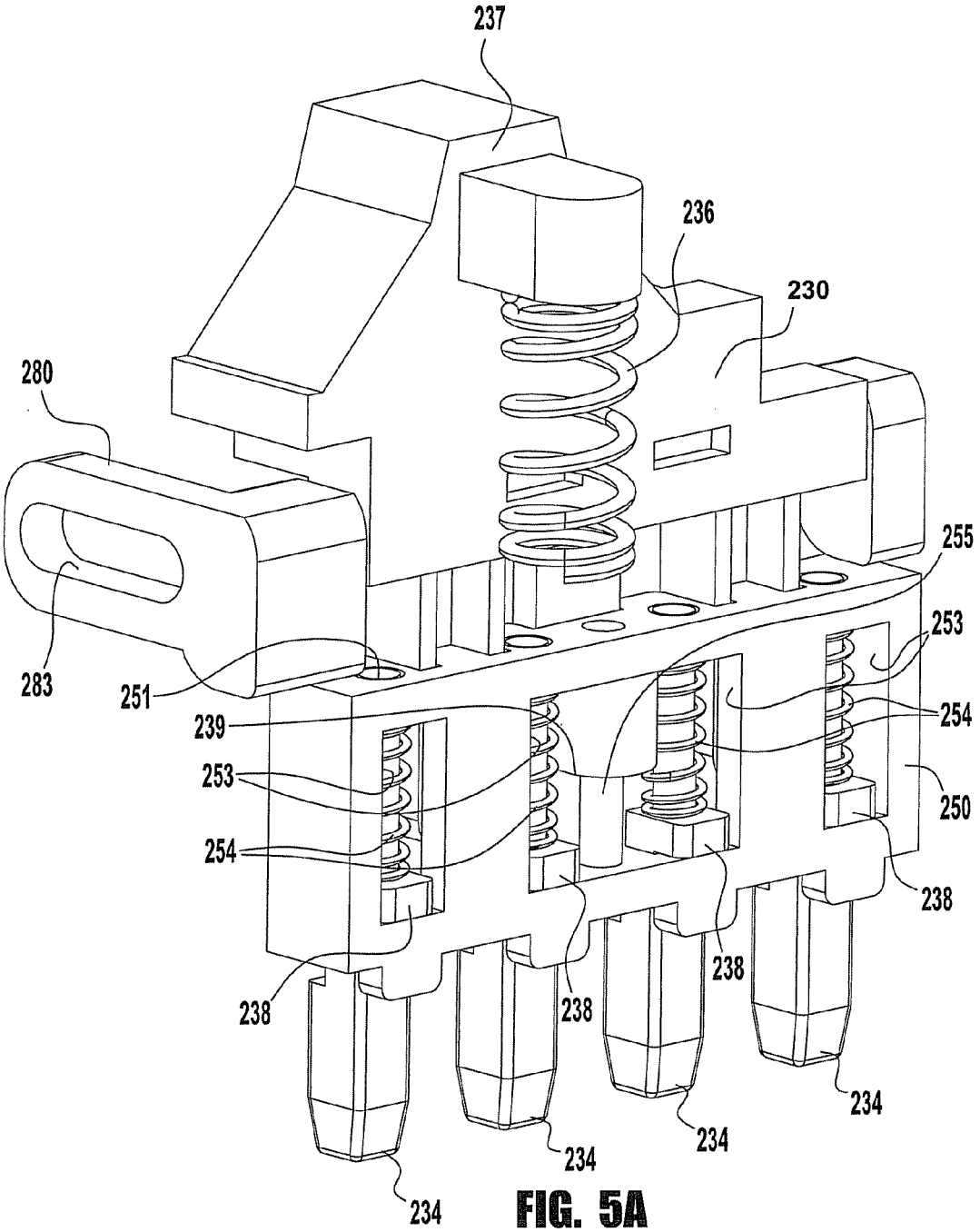
FIG. 5A is a front perspective view of the locking arrangement of the combination lock of FIG. 1, shown in a code identifying condition.
Figure 5B:
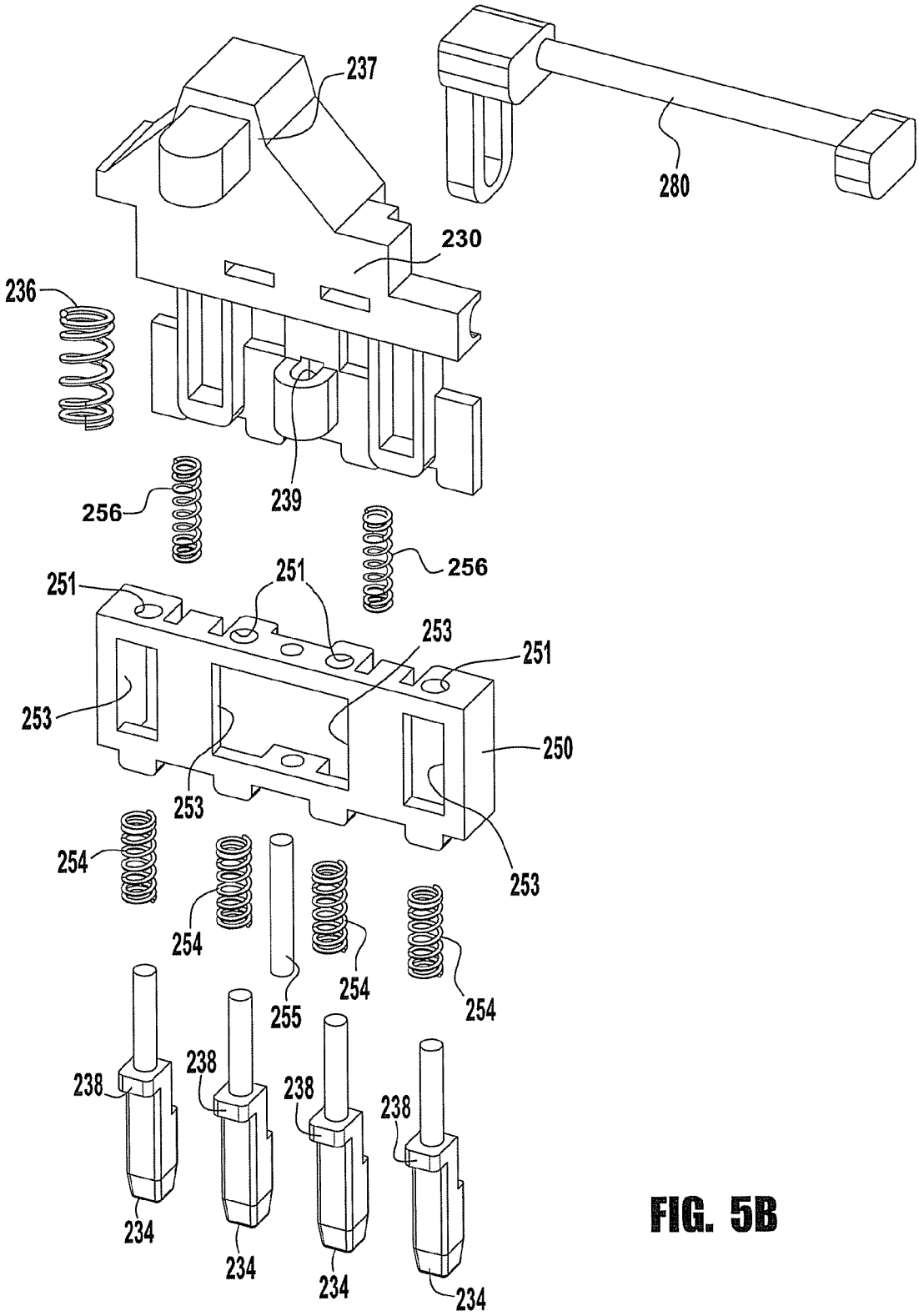
FIG. 5B is an exploded view of the locking arrangement of FIG. 5A.

While many different operative connections may be provided between the key operated cylinder 260 and the code identifying member 250, in the illustrated embodiment, an inner end of the key cylinder 260 engages a disc-shaped cam driver 270, which is rotatable to pivot (via pin 273 in slot 283) a camming lever 280 assembled with the blocking member 230 and partially disposed between the blocking member 230 and the code identifying member 250. Pivoting of the camming lever 280 forces the code identifying member 250 axially downward and away from the blocking member 230 into the code identifying condition, as shown in FIG. 5A. Springs 256 may be provided between a lower portion of the blocking member 230 and an upper portion of the code identifying member (see FIGS. 3 and 5B) to return the code identifying member 250 to the axially upper or code concealing condition when the key cylinder 260 is rotated back to the normal code concealing condition. Also, a guiding pin 255 may be affixed to the code identifying member 250 for sliding movement through a corresponding opening 239 in the blocking member 230 (see FIG. 5B), to maintain alignment of the code identifying member 250 with respect to the blocking member 230.

Figure 7:
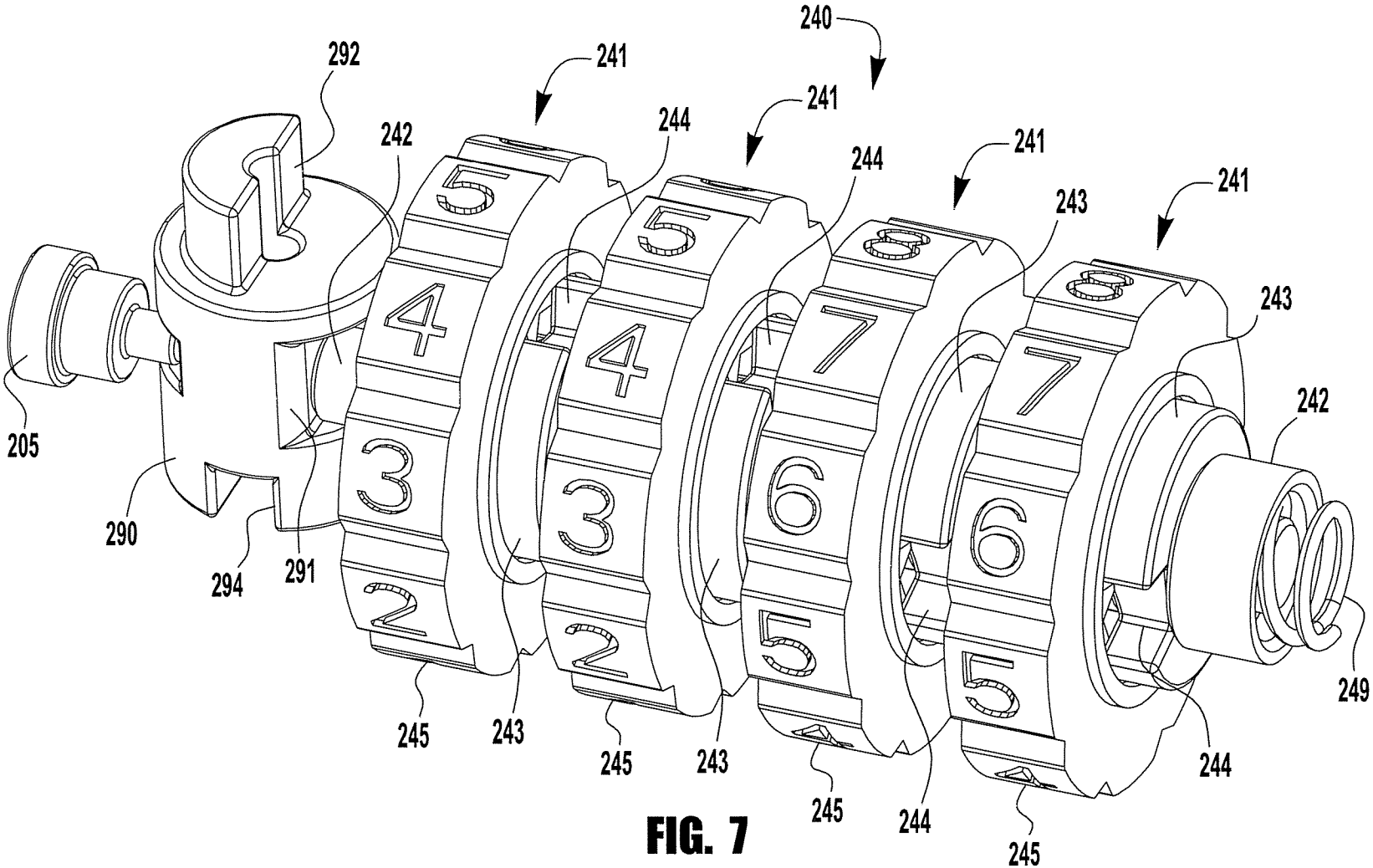
FIG. 7 is a perspective view of the dial assembly and code change mechanism of the combination lock of FIG. 1.

The exemplary lock 200 is also configured to allow an authorized user to change the combination code upon unlocking the lock. As best seen in FIG. 7, a code change member 290 is disposed in the lock body 210 and accessible through an opening 219 (see FIG. 1) in the bottom of the lock body 210. The code change member 290 includes a contoured surface 291 that engages the post 242. When the shackle 220 is locked, the end of the long leg 221 engages a stepped end 292 of the code change member 290 to prevent movement of the code change member (see FIG. 4). When the lock 200 is unlocked and the shackle 220 is lifted, the code change member 290 may be rotated (for example, by a screwdriver inserted in a slot 294 in the exposed end) such that the contoured surface 291 axially pushes the post 242 and hubs 243, disengaging the hubs 243 from the wheels 245. Upon disengagement of the hubs 243 from the wheels 245, the wheels 245 may be rotated to a new authorized combination. Once the new combination has been set, the code change member 290 may be returned to the original position, and a biasing spring 249 returns the post 242 and hubs 243 to reengage the hubs 243 with the wheels 245 in the new orientation. A fastener or pin 205 used to secure the outer casing 213 to the housing 211 may also retain the code change member 290 at the base of the housing 211.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative indicators and ranges may be included to assist in understanding the present disclosure; however, such indicators and ranges are not to be construed in a limiting sense and are intended to be critical indicators or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

We claim:

1. A dial code combination identifying lock comprising:

a lock body;

a plurality of dials assembled with the lock body, each comprising an unlocking feature, each of the plurality of dials being rotatable to an unlocking orientation;

a locking mechanism disposed within the lock body and movable between a locked position and an unlocked position when all of the plurality of dials are in the unlocking orientation;

a shackle having a long leg retained within the lock body and a short leg lockably securable within the lock body when the locking mechanism is in the locked position, and separable from the lock body in an axial direction along an axis defined by the long leg when the locking mechanism is in the unlocked position; and a user operable code identifying mechanism movable between a code concealing condition and a code identifying condition while the shackle remains secured in the locked position, the code identifying mechanism comprising a plurality of separate dial engaging members each biased into engagement with the corresponding dial when the code identifying mechanism is in the code identifying condition, such that rotation of any one of the dials to the unlocking orientation causes the corresponding dial engaging member to engage the corresponding unlocking feature to provide a positive perceptible indication that the corresponding dial is only in the unlocking orientation independent of orientations of the other dials;

wherein the unlocking features comprise recesses on outer peripheries of each of the plurality of dials; and wherein the locking mechanism comprises a blocking member slideable in the axial direction between the locked and unlocked positions, with each of the plurality of dial engaging members being configured to hold the blocking member in the locked position, further wherein when each of the plurality of dials is rotated to the unlocking orientation, each of the corresponding recesses aligns with each of the corresponding ones of the plurality of dial engaging members, allowing the blocking member to slide in the axial direction from the locked position to the unlocked position.

2. The lock of claim 1, wherein the perceptible indication comprises impeded rotation of the dial in both directions beyond the unlocking orientation.

3. The lock of claim 1, wherein the user operable code identifying mechanism comprises a key-operated mechanism rotatable to move the code identifying mechanism from the code concealing position to the code identifying position while the locking mechanism remains in the locked position.

4. The lock of claim 3, further comprising a pivotable caroming lever configured to translate rotational movement of the key operated mechanism to axial movement of the dial engaging members.

5. The lock of claim 1, wherein the code identifying mechanism further comprises a code identifying member axially movable to compress each of a plurality of spring members against the corresponding dial engaging members when the code identifying mechanism is moved to the code identifying condition.

6. The lock of claim 5, wherein the code identifying member comprises a plurality of cavities, each cavity receiving a corresponding one of the plurality of spring members.

7. The lock of claim 5, wherein the code identifying member comprises a plurality of axially extending passages for movably receiving the code identifying members therethrough.

8. A code identifying combination lock comprising:

a lock body;

a plurality of user rotatable dials assembled with the lock body, each including an unlocking feature;

a shackle having a long leg retained within the lock body and a short leg separable from the lock body in an axial direction along an axis defined by the long leg;

a blocker disposed within the lock body and comprising a plurality of separate dial engaging members configured to hold the blocker in a locking position, wherein when each of the plurality of dials is rotated to an unlocking orientation, each of the corresponding unlocking features aligns with each of the corresponding ones of the plurality of dial engaging members, allowing the blocker to slide in the axial direction from the locking position to an unlocking position to permit separation of the short leg of the shackle from the lock body; and a code identifying member assembled with the blocker, the code identifying member being movable between a code concealing condition and a code identifying condition;

wherein when the code identifying member is in the code identifying condition, each of the plurality of dial engaging members is in biased engagement with the plurality of dials, such that rotation of any one of the plurality of dials to the unlocking orientation causes the corresponding dial engaging member to engage the corresponding unlocking feature to provide a positive perceptible indication that the one of the plurality of dials is only in the unlocking orientation independent of orientations of the other dials.

9. The combination lock of claim 8, wherein the perceptible indication comprises impeded rotation of the dial in both directions beyond the unlocking orientation.

10. The combination lock of claim 8, further comprising a key-operated mechanism configured to move the code identifying member from the code concealing condition to the code identifying condition.

11. The combination lock of claim 10, further comprising a pivotable camming lever configured to translate rotational movement of the key operated mechanism to axial movement of the code identifying member in a direction substantially perpendicular to a rotational axis of the plurality of dials.

12. The combination lock of claim 8, wherein each of the plurality of dial engaging members comprises a pin configured to be biased against the corresponding dial when the code identifying member is in the code identifying condition.

13. The combination lock of claim 8, wherein each of the plurality of dials comprises a hub including the unlocking feature and a user rotatable wheel, the hub being separable from the wheel to change the rotational orientation of the wheel with respect to the hub, thereby changing the unlocking orientation of the dial.

14. The combination lock of claim 13, further comprising a code changing member accessible from outside the lock, wherein movement of the code changing member axially separates the hubs from the corresponding wheels.

15. The combination lock of claim 8, further comprising a plurality of spring members each configured to provide spring loaded engagement between the code identifying member and a corresponding one of the dial engaging members when the code identifying member is in the code identifying condition.

16. The combination lock of claim 15, wherein the code identifying member comprises a plurality of cavities, each cavity receiving a corresponding one of the plurality of spring members.

17. The combination lock of claim 8, wherein the code identifying member comprises a plurality of axially extending passages for movably receiving the dial engaging members therethrough.

* * * * *